US012320522B2

(12) United States Patent
Gebel et al.

(10) Patent No.: US 12,320,522 B2
(45) Date of Patent: Jun. 3, 2025

(54) PILOTING ARRANGEMENT, NOZZLE DEVICE, GAS TURBINE ARRANGEMENT AND METHOD

(71) Applicant: Rolls-Royce Deutschland Ltd & Co KG, Blankenfelde-Mahlow (DE)

(72) Inventors: Christoffer Gregor Gebel, Ludwigsfelde (DE); Carsten Clemen, Mittenwalde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 0 days.

(21) Appl. No.: 18/439,244

(22) Filed: Feb. 12, 2024

(65) Prior Publication Data

US 2024/0271786 A1 Aug. 15, 2024

(30) Foreign Application Priority Data

Feb. 14, 2023 (DE) ..... 10 2023 201 244.8

(51) Int. Cl.
*F23R 3/18* (2006.01)
*F23R 3/34* (2006.01)

(52) U.S. Cl.
CPC ..... *F23R 3/18* (2013.01); *F23R 3/343* (2013.01)

(58) Field of Classification Search
CPC .... F23R 3/18; F23R 3/26; F23R 3/283; F23R 3/286; F23R 3/343; F23R 2900/03343
See application file for complete search history.

(56) References Cited

U.S. PATENT DOCUMENTS

| | | | | |
|---|---|---|---|---|
| 4,327,547 | A | 5/1982 | Hughes | |
| 5,243,816 | A * | 9/1993 | Huddas | F02B 77/04 60/734 |
| 10,072,845 | B2 | 9/2018 | Mook | |
| 2019/0093896 | A1* | 3/2019 | Clemen | F23R 3/14 |
| 2021/0101169 | A1* | 4/2021 | Ryon | B33Y 10/00 |
| 2021/0231307 | A1 | 7/2021 | Patel | |

FOREIGN PATENT DOCUMENTS

| | | | |
|---|---|---|---|
| DE | 3021019 | A1 | 12/1980 |
| DE | 112013002290 | T5 | 2/2015 |
| EP | 1445540 | A1 | 8/2004 |
| EP | 3800400 | A1 | 4/2021 |

OTHER PUBLICATIONS

German Search Report dated Nov. 9, 2023 from counterpart German App No. 10 2023 201 244.8.

* cited by examiner

*Primary Examiner* — Scott J Walthour
(74) *Attorney, Agent, or Firm* — SHUTTLEWORTH & INGERSOLL, PLC; Timothy J. Klima

(57) ABSTRACT

A pilot arrangement for a nozzle of a gas turbine, in particular of an aircraft engine, including: a cavity extending along a longitudinal axis for conducting fuel, a narrowest flow cross section of which is larger than a flow cross section of a pilot fuel nozzle, in particular a pilot line. The pilot fuel nozzle, which adjoins the cavity in a downstream direction includes the pilot line and a pilot fuel outlet arranged at the downstream end of the pilot line, the narrowest flow cross section of which is configured to be smaller than that of the cavity. Reliable operation is made possible by virtue of an air opening arranged on the pilot arrangement in flow connection with the cavity so there can be an at least occasional flow of air through at least the cavity and the pilot fuel nozzle during the operation of the gas turbine.

14 Claims, 7 Drawing Sheets

PILOTING ARRANGEMENT, NOZZLE DEVICE, GAS TURBINE ARRANGEMENT AND METHOD

Figure 1C:
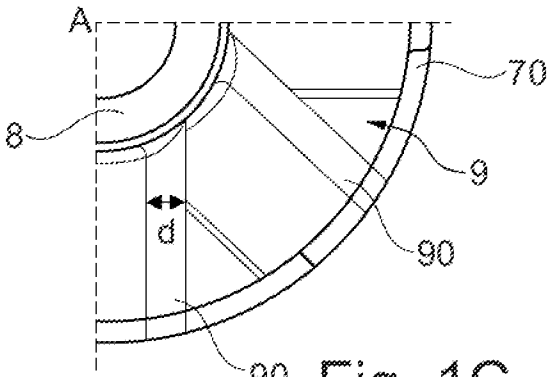
Fig. 1C (Prior Art)

This application claims priority to German Patent Application 102023201244.8 filed Feb. 14, 2023, the entirety of which is incorporated by reference herein.

The invention relates to a pilot arrangement for use in a nozzle device of a gas turbine arrangement, in particular of an aircraft engine, according to features as disclosed herein. The invention furthermore relates to a nozzle device, a gas turbine arrangement and a method for operating a gas turbine arrangement.

Fuel nozzles frequently have a pilot stage (pilot means) so as to carry out combustion processes in a stable manner in an aircraft engine over as wide an operating range as possible. In this case, less fuel is supplied via the pilot means than via a main stage. The combustion process via the pilot stage is operated in a stable range, thus stabilizing the combustion process via the main stage under unstable operating conditions.

A pilot arrangement of the type mentioned at the outset is specified in U.S. Pat. No. 10,072,845 B2. In this document, the dimensions of the nozzle device comprising the pilot arrangement are relatively large.

A further pilot arrangement, in a nozzle device which likewise has relatively large dimensions, is specified in EP 1 445 540 A1.

US 2014/0291418 A1 shows a nozzle device comprising two air channels for operating with two air flows ("two-flow fuel nozzle"), without a pilot means.

With compact pilot arrangements, in particular, there is the risk of coking within fuel-carrying parts containing residual fuel when the pilot arrangement is temporarily not in operation. This can lead to clogging and to restricted operation, and even to failure, of the pilot arrangement.

The object on which the present invention is based is that of providing a pilot arrangement that can be operated in a reliable manner, and a nozzle device having a pilot arrangement, a gas turbine arrangement, and a method for operating a gas turbine arrangement.

The object is achieved with respect to the pilot arrangement by features as disclosed herein. The object is achieved with regard to a nozzle device, with regard to a gas turbine arrangement and with regard to a method for operating a gas turbine arrangement by features as disclosed herein.

In the pilot arrangement, it is envisaged according to the invention that an air opening is arranged on the pilot arrangement in such a way in flow connection with the cavity that there can be an at least occasional flow of air through at least the cavity and the pilot fuel nozzle during the operation of the gas turbine arrangement.

The cavity acts in particular as a settling chamber for pilot fuel supplied from (a) pilot fuel supply line(s).

Any pilot line of the pilot fuel nozzle that may be present can have a constant flow cross section over the axial length.

By means of the air opening, it is advantageously possible to purge fuel-carrying parts of the pilot arrangement, such as the cavity and/or the pilot fuel nozzle, with air in order to remove residual fuel and thus minimize the risk of coking within the pilot arrangement. Thus, the proposed design leads to reliable operation of the pilot arrangement.

For a particularly compact configuration, it is expediently provided that the cavity is arranged in a central body arranged on the longitudinal axis, and that at least one swirling element is arranged in a circumferential manner around the central body, wherein the central body and the at least one swirling element form a swirling arrangement. Thus, the pilot arrangement advantageously has a dual function, wherein the pilot arrangement is simultaneously configured as a swirling arrangement or has the swirling arrangement.

In a particularly preferred configuration variant, it is provided that the at least one swirling element, the central body and the pilot fuel nozzle are configured as a continuous, integral component. The integral component obtained, which serves as a pilot arrangement and as a swirling arrangement, can advantageously have a configuration which is very highly optimized in terms of installation space.

Further contributing to a compact configuration of the pilot arrangement is the provision of at least one pilot fuel supply line for supplying fuel into the cavity, wherein the at least one pilot fuel supply line is guided through the at least one swirling element, for conducting pilot fuel from a circumferential wall of an inner air channel radially inwards into the cavity. Where a plurality of swirling elements is provided, a plurality of pilot fuel supply lines is preferably provided, wherein preferably a plurality and/or each of the swirling elements has at least one pilot fuel supply line.

An advantageous air supply for purging the pilot arrangement can be achieved if the air opening is arranged on a side of the pilot arrangement which (after installation) faces upstream in relation to an air inflow direction (during operation), in direct flow contact with the (i.e. at the) cavity, in particular centrally on the longitudinal axis. During operation, the air inflow is provided by the air flowing through the inner air channel. In this case, the air opening is preferably routed to the cavity from the outside through the central body. In this case, any hollow chamber which is present is penetrated by the air opening, with fluid-tight sealing being provided by means of the wall around the air opening, for example. Alternatively or in addition, the air opening is arranged on the at least one swirling element in direct flow contact with the (i.e. at the) at least one pilot fuel supply line, preferably as far as possible radially outwards on the swirling element within the inner air channel. This ensures that, when there is a throughflow of air, the at least one pilot fuel supply line is purged in addition to the cavity and the pilot fuel nozzle. If there is a plurality of swirling elements present, the air opening is preferably arranged on each swirling element that carries fuel, i.e. has a pilot fuel supply line.

The air opening is preferably configured to generate a pressure loss during operation such that, when there is a fuel flow through the pilot arrangement, there is no flow of air through the air opening and, after the fuel has been switched off, there is an at least occasional flow of air through it. The configuration is furthermore preferably such that air flows from upstream to downstream through the air opening (with respect to the routing of air in the nozzle arrangement), but not in the opposite direction (and especially not with fuel). As a particular preference, the air opening is configured as a throttle element, which sets the desired air flow on the basis of fluid-dynamic self-regulation, without additional open-loop and/or closed-loop control. The fuel flow itself also preferably contributes to generating the required pressure loss, e.g. by forming standing vortices within the fuel flow at or within the air opening and/or by influencing the flow cross section on the basis of adhesion or capillarity of the fuel, e.g. at walls and/or downstream of orifice openings.

In particular, the above functionality can be achieved if the air opening has at least one orifice opening and/or a porous structure, e.g. a porous structure formed by sintering loose material such as balls, particles or chips. In the configuration with an orifice opening, it is possible, in particular, to arrange and form a plurality of orifice openings and/or spaces of widened cross section in a suitable manner, e.g. in series, in order to bring about the required pressure drop and/or pressure profile (pressure difference) across the air opening, in particular the throttle element. The precise configuration of the precise design and/or arrangement is preferably carried out experimentally and/or with computer support by means of flow simulation.

In a preferred configuration variant, the air opening can be configured as a throttle element produced integrally with the pilot arrangement or produced separately and installed afterwards, in particular welded or brazed in.

For thermal shielding of the cavity and/or the pilot line, a hollow chamber is arranged as a heat shield, preferably in a circumferential manner around the pilot fuel nozzle, in particular around the pilot line, and/or the cavity. The hollow chamber is preferably fluidically connected, i.e. a single continuous hollow chamber is provided. The hollow chamber is configured around the pilot line, for example as a gap-like chamber which is, at least in portions, fully circumferential. Around the cavity, the hollow chamber is preferably configured so as to be complementary to the shape of the cavity, wherein a wall provided between the cavity and the hollow chamber can, for example, have an at least substantially constant thickness. Air and/or fuel-carrying fluid ducts (for example the air opening, pilot fuel supply line(s) and/or the pilot line) passing through the hollow chamber into or out of the cavity are configured to be fluid-tight relative to the hollow chamber.

In this case, it can advantageously be provided that the hollow chamber is sealed in a flow-tight manner relative to the environment (an air atmosphere surrounding the pilot arrangement). In this way, no exchange of substances, in particular no gas exchange, can occur between the hollow chamber and the environment.

Particularly effective thermal shielding is achieved if the hollow chamber is filled with an inert gas (for example argon or xenon) or evacuated (i.e. subjected to a vacuum). The inert gas takes the form in particular of a gas with a lower thermal conductivity than air (which has a thermal conductivity of 0.0262 W/mK).

The pilot means can be advantageously relocated into the region of the outlet of the inner air channel if, at the downstream end of the central body, a lance is provided which extends on the longitudinal axis and in which the pilot line extends at least for the most part, wherein the lance comprising the pilot line has an axial length such that the fuel outlet is positioned at least in a downstream third or quarter, preferably at least substantially at an outlet, of an inner air channel of the nozzle device.

The nozzle device according to the invention comprises a pilot arrangement according to any one of the configuration variants specified above and an inner air channel, which is arranged on a central longitudinal axis of the nozzle device and within which the pilot arrangement is arranged coaxially with the inner air channel, wherein, in particular, the longitudinal axis lies on the central longitudinal axis. The air opening is arranged within the inner air channel.

To achieve relatively low pressure loss and a relatively large available installation space, the central body and the swirling element(s) are preferably arranged upstream of the narrowest flow cross section of the inner air channel.

Optionally, the inner air channel, comprising a (for example cylindrical) wall enclosing the inner air channel, can form, at least in part, a portion of the integral component which comprises and/or forms the pilot arrangement.

The pilot fuel nozzle is arranged in the central body and/or at least in part within the lance. Where the lance is provided, the lance is preferably manufactured together with the integral component and is thus an integral part thereof.

In the method for operating a gas turbine arrangement, it is provided that, in a pilot arrangement of a nozzle device, there is an at least occasional flow of air through at least a (fuel-carrying) cavity and a pilot fuel nozzle during operation, wherein, during operation of the pilot arrangement, with fuel flow through the same, there is no flow of a medium, in particular air and/or fuel, through an air opening in flow contact with the cavity and the pilot fuel nozzle, and, when the pilot arrangement is deactivated (without fuel flow through the latter), there is an at least occasional throughflow of air in the direction of the pilot fuel nozzle.

Advantageous embodiment variants of the method are set out in connection with the configuration variants of the pilot arrangement.

Figure 1B:
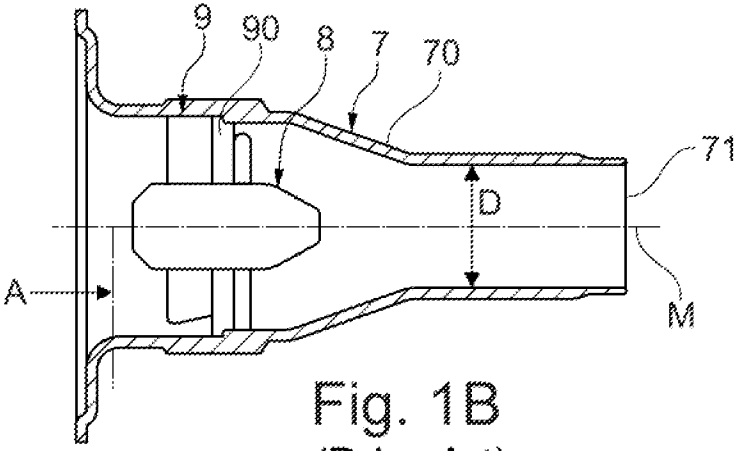
Fig. 1B (Prior Art)
Figure 1A:
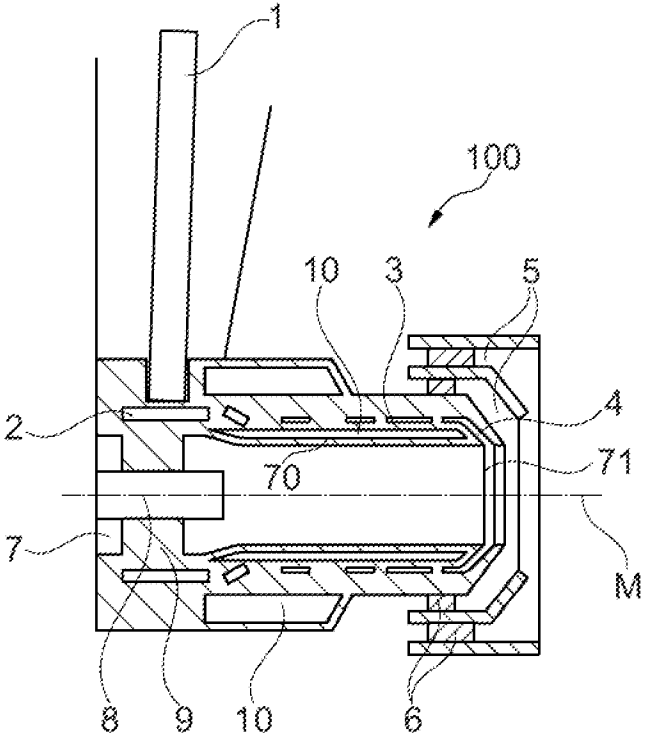
Fig. 1A (Prior Art)
Figure 2B:
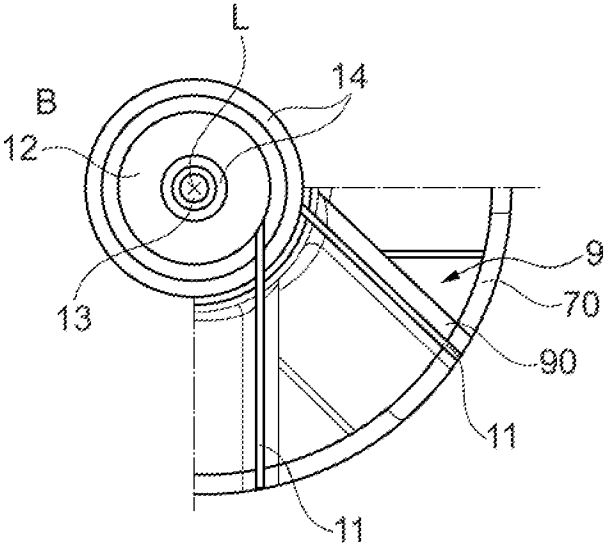
Figure 2A:
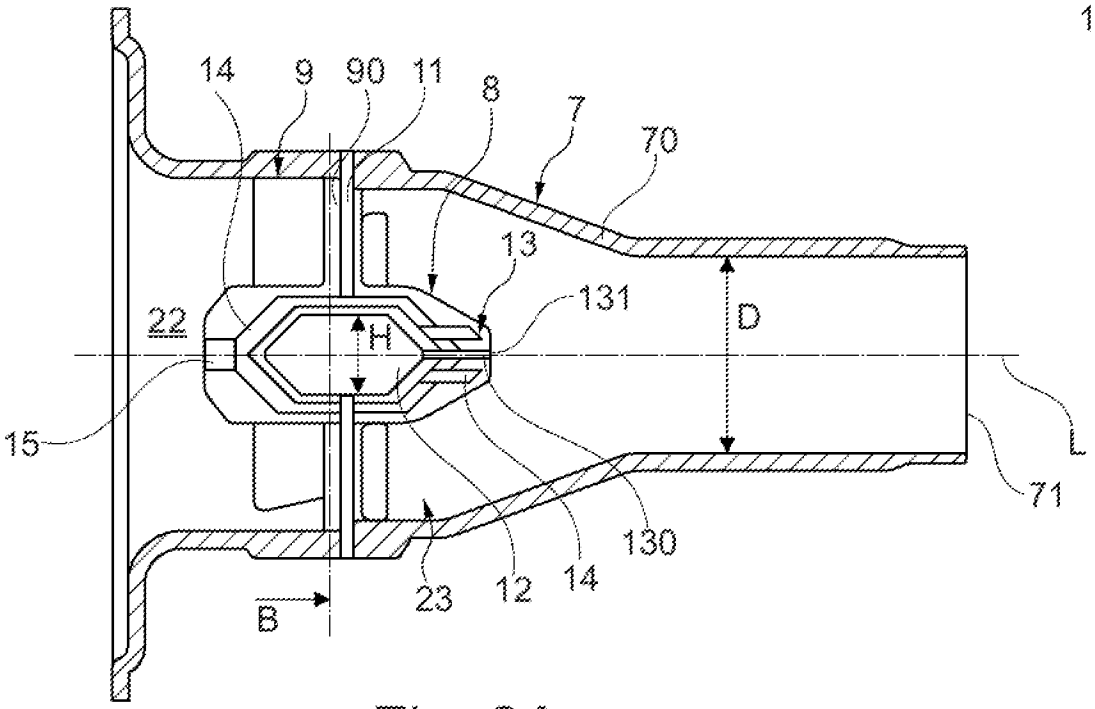
Figure 3:
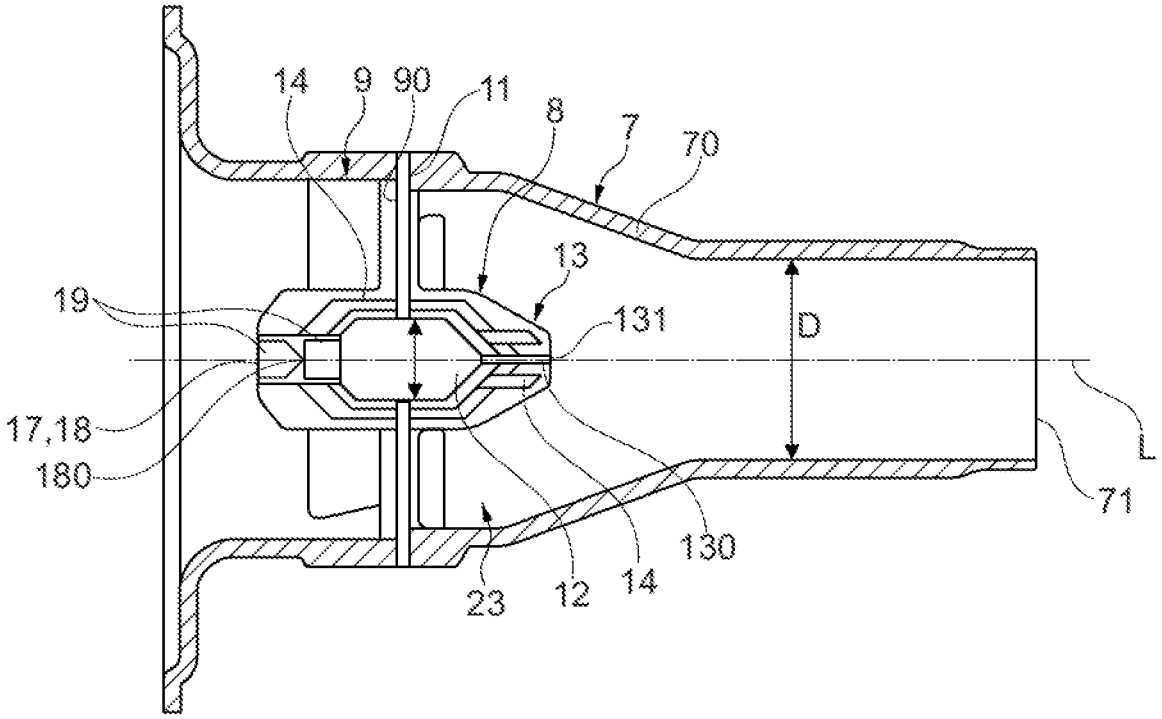
Figure 4:
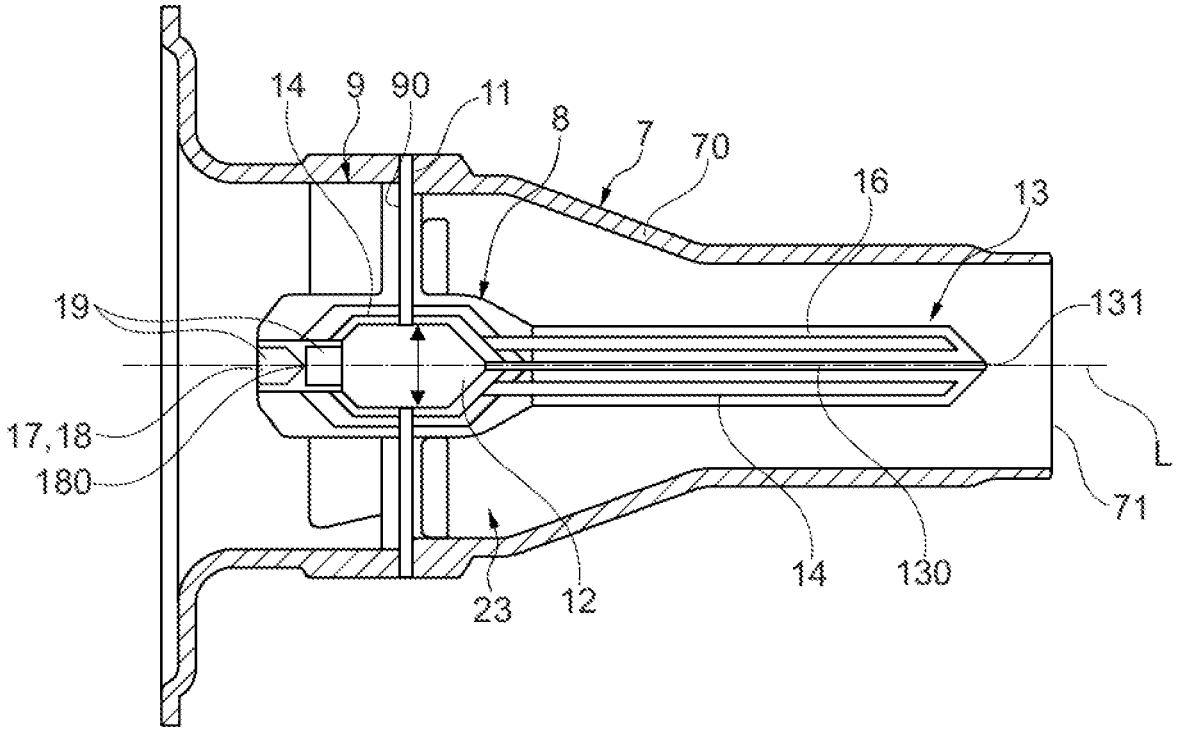
Figure 5:
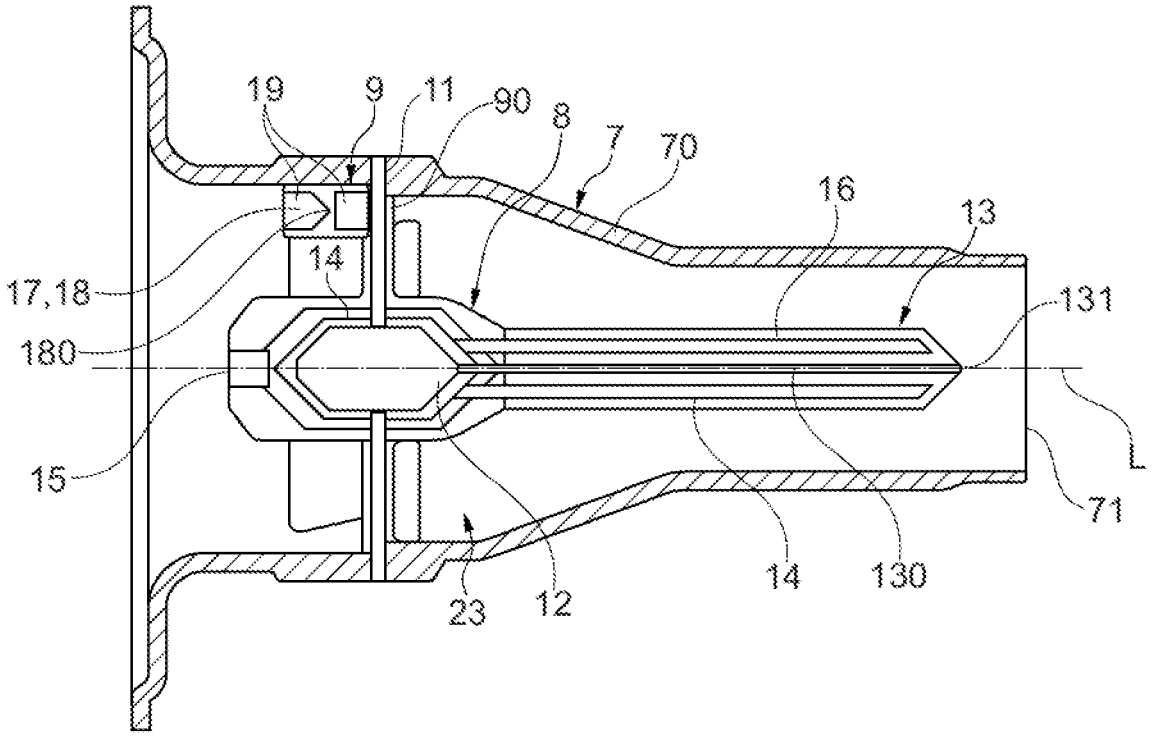
Figure 6A:
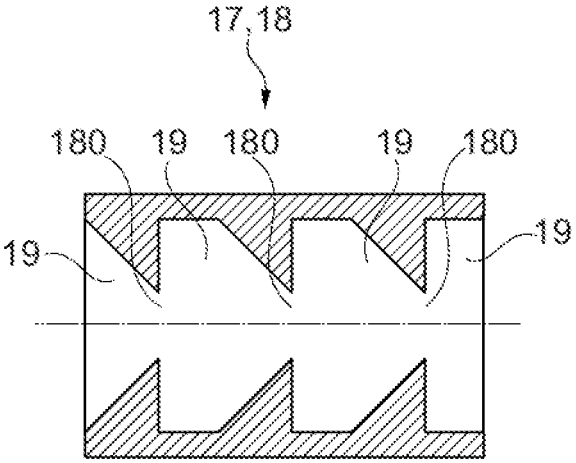
Figure 6B:
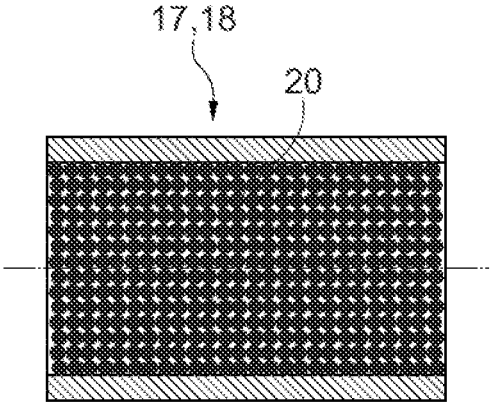
Figure 6C:
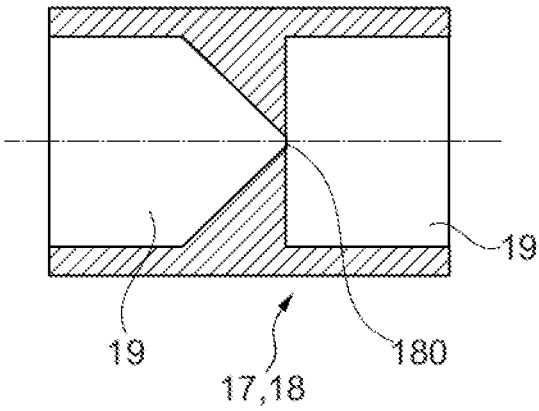
Figure 6D:
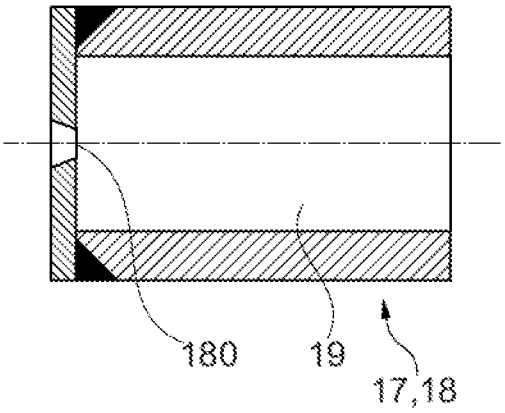
Figure 7:
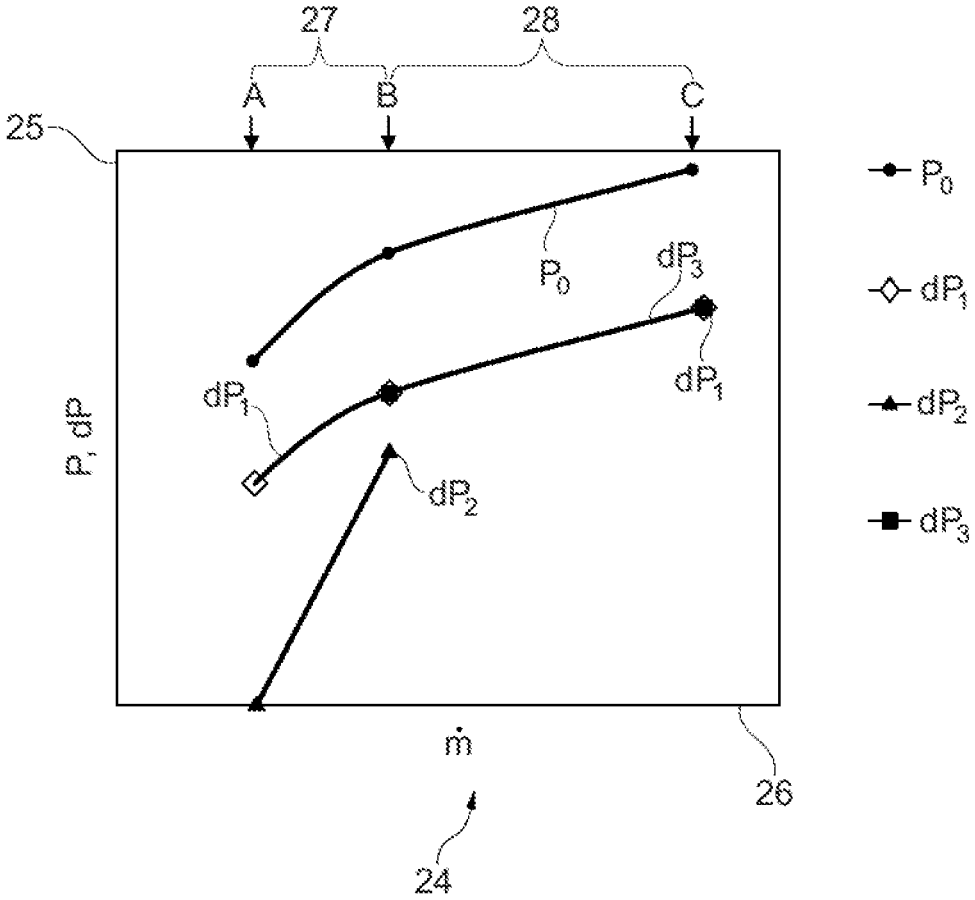

The invention will be explained in more detail hereunder by means of exemplary embodiments with reference to the drawings, in which:

FIGS. 1A, 1B, 1C show a longitudinal sectional view of a nozzle device comprising a swirling arrangement, without a pilot means, according to the prior art (FIG. 1A), a longitudinal sectional view of an inner air channel of the nozzle device (FIG. 1B) and a partial sectional view of the swirling arrangement along a section line A (FIG. 1C), FIGS. 2A, 2B show the inner air channel of the nozzle device configured according to the prior not contained in prior publications, in which a swirling element, a central body and a pilot fuel nozzle of the pilot arrangement are configured as an integral component, in a longitudinal section (FIG. 2A) and a partial section through the pilot arrangement along a section line B (FIG. 2B), FIG. 3 shows a longitudinal sectional view of the inner air channel of a nozzle device according to the invention comprising an air opening arranged on a cavity of the pilot arrangement, FIG. 4 shows a longitudinal sectional view of the inner air channel of the nozzle device according to the invention comprising a further configuration variant of the pilot arrangement, FIG. 5 shows a longitudinal sectional view of the inner air channel of the nozzle device according to the invention comprising a further configuration variant of the pilot arrangement, wherein the air opening is arranged on the swirling element, FIGS. 6B, 6B, 60, 6D show different configuration variants of the air opening, and FIG. 7 shows a diagram of the pressure and pressure difference against a fuel mass flow, in each case plotted in logarithmic form, during the operation of the nozzle device as a qualitative illustration of an illustrative mode of operation of the air opening.

FIG. 1A shows a longitudinal sectional view of a nozzle device 100 comprising three air channels 5, 7 ("3-flow fuel nozzle"), as known from the prior art. Nozzle devices 100 of this type are used in gas turbine arrangements, in particular in aircraft engines. FIG. 1B shows a longitudinal sectional view of the inner air channel 7 of the nozzle device 100, with an integrated central body 8. FIG. 1C shows a partial sectional view of the inner air channel 7 along the line A of intersection.

The nozzle device 100 shown in FIGS. 1A to 1C is configured in particular for operating with a liquid fuel (kerosene-based or kerosene-related).

The nozzle device 100 has a fuel feed 1 which is connected in terms of flow for providing fuel during operation to an annular fuel reservoir 2 of the nozzle device 100. Arranged downstream of the annular fuel reservoir 2 is an annular fuel line 3, which provides fuel to a fuel injector 4 of the nozzle device 100 during operation. The fuel is injected into a combustion chamber (not shown in this case) by means of the fuel injector 4.

The fuel injector 4 is radially surrounded by two circumferential air channels 5, a radially outer air channel and a radially central air channel. Swirling elements 6 are arranged within each of the air channels 5.

In a central position on a central longitudinal axis M, the nozzle device 100 comprises the inner air channel 7 which is enclosed by a wall 70, in particular a cylindrical wall. The inner air channel 7, at the downstream end thereof, has an outlet 71 for adjoining the combustion chamber. An internal diameter D in a downstream portion and/or at the outlet 71 can be 7 mm to 15 mm for example.

Provided between the inner air channel 7 and the annular fuel line 3 and/or the fuel injector 4 is an air chamber 10 for thermally shielding (i.e. acting as a heat shield) these fuel-carrying lines.

Arranged within the inner air channel 7 is a swirling arrangement 9, which has a central body 8 in a central position on the central longitudinal axis M. Swirling elements 90 of the swirling arrangement 9 are arranged around the central body 8 for generating a swirl flow within the inner air channel 7 during operation and extend from the central body 8 in a radial-tangential direction to the wall 70. An example thickness d of the swirling elements 90 is 0.8 mm to 1.5 mm. The swirling elements 90 and the central body 8 are manufactured as separate components which are joined to one another prior to installation, for example during assembly of the nozzle device 100.

Stability problems can arise during operation using the nozzle device 100 according to FIGS. 1A to 1C, wherein for example, a lean blowout can occur. A pilot means can be used for stabilisation purposes, but this is difficult to implement, however, in particular in small nozzle devices 100 due to a lack of installation space.

FIG. 2A shows the inner air channel 7 in a longitudinal section, and FIG. 2B shows a pilot arrangement 23 in a partial section along section line B, as indicated in DE 10 2022 208 337.7, filed at the German Patent and Trademark Office on 10 Aug. 2022, as prior art which was not a prior publication on the application date. By virtue of the possibility of its compact construction, the pilot arrangement 23 can be inserted easily into nozzle devices 100, even those of relatively small dimensions, as shown, for example, in FIG. 1A.

The pilot arrangement 23 has a cavity 12 which is arranged centrally on a longitudinal axis L and extends along the longitudinal axis L. In particular, the longitudinal axis L is arranged on the central longitudinal axis M of the nozzle device 100. Furthermore, the pilot arrangement 23 has a pilot fuel nozzle 13 comprising a pilot line 130, which extends in an axial manner centrally on the longitudinal axis L, and a fuel outlet 131, which is arranged at the downstream end of the pilot line 130. The pilot fuel nozzle 13 is arranged directly downstream of and is connected in terms of flow to the cavity 12 and is fed with fuel from the cavity 12 during operation.

The narrowest flow cross section of the cavity 12 is configured to be larger than the flow cross section of the pilot fuel nozzle 13, in particular the pilot line 130. For example, a maximum height H of the cavity (for example a diameter) corresponds to ¼ to ¾ of the smallest diameter D of the inner air channel 7. The cavity 12 acts in particular as a settling chamber for the fuel flow.

The pilot arrangement 23 is integrated into the swirling arrangement 9 for a particularly compact construction. In this case, the cavity 12 is arranged in the central body 8 of the swirling arrangement 9, in particular symmetrically relative to the longitudinal axis L. The swirling elements 90 are arranged radially in a circumferential manner around the central body 8 comprising the cavity 12. The pilot fuel nozzle 13 can also be arranged in the central body 8 and/or at least partially in a lance 16 which is arranged at the downstream end of the central body 8 and extends centrally on the longitudinal axis L (cf. for example FIGS. 4 and 5).

For a compact, fluid-tight configuration, the pilot arrangement 23 is configured with the swirling elements 90 and the central body 8 comprising the cavity 12, preferably as a continuous, integral component.

The pilot arrangement 23 moreover comprises, by way of example, a plurality of pilot fuel supply lines 11 for supplying fuel into the cavity 12. For a particularly compact design, the pilot fuel supply lines 11 are guided through the swirling elements 90 from the radially exterior region, i.e. from the wall 70 of the inner air channel 7, inwards to the cavity 12. For this purpose, a corresponding distribution line for providing the pilot fuel supply lines 11 with fuel (not shown in this case) is preferably arranged in the wall 70.

For thermal shielding of the cavity 12 and/or the pilot line 130, a hollow chamber 14, for example, is arranged as a heat shield within the central body 8 in a circumferential, preferably at least substantially fully circumferential, manner around the pilot line 130 and/or the cavity 12. Preferably, precisely one (continuous in terms of flow) hollow chamber 14 is provided. On its upstream side, the hollow chamber 14 is sealed by means of a weld 15. The pilot fuel supply lines 11 are configured to be fluid-tight relative to the hollow chamber 14.

For effective heat shielding, the hollow chamber 14 is sealed in a flow-tight manner relative to an environment 22, i.e. an air atmosphere surrounding the pilot arrangement 23, and is particularly advantageously filled with an inert gas or evacuated. The inert gas can take the form in particular of a gas with a lower thermal conductivity than air, for example argon (thermal conductivity 0.0179 W/mK) or xenon (thermal conductivity: 0.0055 W/mK). An optimized heat shield effect is achieved by the inert gas or vacuum, thereby effectively minimizing heat input from the inner air channel 7 (with air temperatures of approximately 600° C.) to the fuel (approximately 50° C.) within the cavity 12 and/or the pilot line 130, even when the dimensions involved are small.

FIG. 3 shows the pilot arrangement 23 illustrated in FIG. 2A with the addition of a refinement according to the invention. In this case, an air opening 18 is arranged on the pilot arrangement 23 in such a way in flow connection with the cavity 12 that there can be an at least occasional flow of air through the cavity 12 and the pilot fuel nozzle 13 during the operation of the gas turbine arrangement. During operation, at least at certain operating points, the air inflow is provided by the air flowing through the inner air channel 7, of which a proportion flows through the pilot arrangement 23. By means of the air opening 18, it is thus possible for fuel-carrying parts of the pilot arrangement 23, such as the cavity 12 and the pilot fuel nozzle 13, to be purged with air in order to remove residual fuel. In this way, coking within the pilot line 130 and/or the cavity 12, which may lead to clogging of fuel-carrying parts, associated with restricted operation of the pilot arrangement 23 and even failure thereof, is prevented.

The air opening 18 is configured to generate a pressure loss during operation such that there is no flow of air through the air opening when fuel is flowing through the pilot arrangement 23. After the fuel is switched off, there is an at least occasional flow of air through the pilot arrangement 23 from the direction of the inner air channel 7 into the pilot arrangement 23, in the exemplary embodiment shown into the cavity 12. The throughflow is from the same side as the inner air channel 7 but not in the opposite direction (and especially not with fuel).

As a particular preference, the air opening 18 is configured as a throttle element 17, which sets the desired air flow on the basis of fluid-dynamic self-regulation, without additional open-loop and/or closed-loop control. When fuel is flowing, the fuel flow itself also preferably contributes to generating the required pressure loss, e.g. by forming standing vortices within the fuel flow at or within the air opening 18 and/or by influencing the flow cross section on the basis of adhesion or capillarity of the fuel, e.g. at walls and/or downstream of orifice openings 180.

To produce these modes of operation, the throttle element 17 is configured in FIG. 3, by way of example, as comprising an orifice opening 180, upstream and downstream of which there are respective spaces 19 of widened cross section (cf. also FIG. 6C). The space 19 arranged upstream (on the same side as the inner air channel 7) has a conical portion as a transition to the orifice opening 180, whereas the orifice opening 180 makes a transition to the downstream space 19 (on the same side as the cavity) by means of a step change in the cross section.

The side of the air opening 18 which faces in the upstream direction is arranged in the direction of the upstream-facing side of the inner air channel 7, i.e. on that side of the pilot arrangement 23 which faces upstream with respect to the air inflow direction. This ensures that, during operation, it is the air flowing through the inner air channel 7 that flows into the air opening 18. In the exemplary embodiment shown in FIG. 3, the air opening 18 is arranged in direct flow contact with the cavity 12 and lies centrally on the longitudinal axis L. In this case, the air opening 18 is arranged on the cavity 12 by means of the wall of the central body 8 and, at the same time, in a manner sealed off fluid-tightly with respect to the hollow chamber 14.

FIG. 4 shows an exemplary embodiment of the pilot arrangement 23 according to the invention, in which the pilot fuel outlet 131 is arranged in the downstream third of the inner air channel 7 in the vicinity of the outlet 71. For this purpose, the lance 16, which extends coaxially with the inner air channel 7 on the longitudinal axis L, is arranged at the downstream end of the central body 8. At least the majority of the pilot line 130 extends within the lance 16. A portion of the hollow chamber 14, which surrounds the pilot line 130 at least for the most part, is also configured within the lance 16. The lance 16 enables the heat release zone to be located further downstream during the pilot combustion process.

The lance 16 is preferably also manufactured integrally with the central body 8 and the swirling elements 90, i.e. the integral component comprising the pilot arrangement also comprises the lance 16.

Just as in the exemplary embodiment shown in FIG. 3, the air opening 18 is arranged centrally on the longitudinal axis L in direct flow contact with the cavity 12.

The flow cross sections of the pilot line 130 and/or the pilot fuel supply lines 11 are preferably configured to be round and/or rhombic.

FIG. 5 shows an exemplary embodiment of the pilot arrangement 23 according to the invention, wherein the air opening 18 is arranged in direct flow contact with, here by way of example, one of the pilot fuel supply lines 11 on one of the swirling elements 19. The upstream side of the air opening 18 likewise faces in the direction of the upstream side of the inner air channel 7. The air opening 18 is likewise aligned coaxially with the longitudinal axis L. The arrangement of a respective air opening 18 on each pilot fuel supply line 11 would also be advantageous. By means of this arrangement it is possible not only to purge the cavity 12 and the pilot fuel nozzle 13 but also some portion or portions of the pilot fuel supply line/s 11 with air.

FIGS. 6A to 6D show air openings 18, each configured as throttle elements 17, as possible exemplary embodiments for generating the self-regulating modes of operation. The configuration of the precise shapes, arrangement, cross section and/or length ratios is preferably carried out experimentally and/or with computer support by means of flow simulation.

The air opening 18 in the configuration as a throttle element 17 can, for example, be produced integrally with the pilot arrangement 23 and, if appropriate, with the nozzle device 100 itself, in particular printed in an additive manufacturing method. Separate manufacture of the throttle element 17, e.g. from several parts, conventionally as an individual part or by means of additive manufacturing (3D printing) is also possible. The preferred manufacturing method also depends, in particular, on the precise configuration of the throttle element 17.

FIG. 6A shows the throttle element 17 with, by way of example, three orifice openings 180 arranged one behind the other, upstream and downstream of which a respective space 19 of widened cross section is arranged. On the downstream side in each case, the orifice openings 180 and the spaces 19 are connected to one another by means of step changes in cross section, while, as regards the upstream sides, they merge continuously, by means of conical portions, into the orifice openings 180.

FIG. 6B shows the throttle element 17 by way of example, comprising an open porous structure 20, in this case with sintered spherical elements. Other sintered loose materials, e.g. particles, pellets or chips, are also possible. The porous structure 20 can consist of metal, glass and/or ceramic, or can contain at least one of these materials.

FIG. 6C shows the throttle element 17 by way of example with a single orifice opening 180, the flow diameter of which is configured so as to be smaller than the orifice openings shown in FIG. 6A.

FIG. 6D shows the throttle element 17 by way of example with an inlet-side orifice opening 180, wherein an elongate space 19 with a widened cross section is arranged downstream of the orifice opening 180.

FIG. 7 shows a diagram 24, which is used to explain an illustrative mode of operation of the air opening 18. In this case, an absolute pressure P is plotted logarithmically on an ordinate 25, as is an absolute pressure difference dP, against an abscissa 26 with a logarithmically plotted fuel mass flow m via the nozzle device 100 under different illustrative operating conditions. More specifically, the operating conditions are an ignition condition A, a low load condition B, and a high load condition C of the illustrative engine.

The diagram 24 shows qualitatively the characteristic of an absolute air pressure P0 of the air upstream of the pilot arrangement 23 within the inner air channel 7. Furthermore, the diagram 24 shows the characteristic of an absolute pressure difference dP1 of the air via the nozzle device 100 (dP1=P0−P(pressure downstream of the nozzle device 100)). Furthermore, the diagram 24 shows the characteristic of an absolute pressure difference dP2 of the air via the air opening 18 in relation to the fuel located in the cavity 12 (dP2=P0−P(fuel in the cavity 12)). Furthermore, the diagram 24 shows the characteristic of an absolute pressure difference dP3 of the air via the pilot arrangement 23, i.e. via the air opening 18, the cavity 12 and the pilot fuel nozzle 13.

Under the ignition conditions A, the pilot arrangement 23 is in operation, i.e. there is a flow of pilot fuel through it (fuel throughflow 27). Within the cavity 12, the fuel pressure (not shown directly in the diagram 24) is close to or slightly above the air pressure P0 upstream of the pilot arrangement 23. Within the pilot fuel nozzle 13 with the pilot line 130, the fuel pressure at the pilot fuel outlet 131 is significantly lower than the air pressure P0. The fuel thus flows downstream out of the cavity 12 into the pilot line 130, since it is in this direction that the greatest pressure gradient is present, and not via the air opening 18. No air flows via the air opening 18 into the cavity 12 since there is no pressure gradient across the air opening 18 (cf. pressure difference dP2 under pressure condition A in FIG. 7) or the pressure gradient is too small (cf. pressure difference dP2 under ignition condition B with fuel throughflow 27 in FIG. 7) to generate an air flow, wherein the configuration as a throttle element 17 counteracts the formation of an air flow, especially in conjunction with the fuel flow. The throttle element 17 is, for example, designed in such a way that slight pressure fluctuations of, for example, up to 2% are possible without generating an air flow via the air opening 18.

Under the low load conditions B, the pilot arrangement 23 is deactivated, wherein the transition from fuel throughflow 27 (illustrated by means of dP2) to air throughflow 28 (illustrated by means of dP3) of the pilot arrangement 23 takes place via the air opening 18, without pilot operation.

Before the pilot fuel is switched off, with fuel throughflow 27, the pressure prevailing in the cavity 12 is somewhat lower than the air pressure P0, but higher than the pressure downstream of the nozzle device 100, within a combustion chamber arranged downstream of the nozzle device 100 (i.e. dP2 is lower than dP1 under low load conditions B). No air flows via the air opening 18 since, by virtue of its configuration as a throttle element 17, especially in conjunction with the fuel flow, as indicated above, an inflow of the air is hindered or prevented.

If the pilot fuel flow is switched off (change over to air throughflow 28), the pressure in the cavity 12 falls since it is no longer maintained by a fuel pump (in particular, the fuel pump is switched off or decoupled by a valve). Effects of the fuel that hinder an air flow, such as standing vortices, disappear. The result is a larger pressure gradient from the inner air channel 7 to the cavity 12. As a result, there is an air flow via the air opening 18 into the pilot arrangement 23, and this gradually displaces the fuel from the cavity 12 and the pilot fuel nozzle 13 in the direction of the outlet 71 of the nozzle device 100 into the combustion chamber. In the process, the pressure difference dP3 is established across the air opening 18, the cavity 12 and the pilot line 130, such that it (almost) corresponds to the pressure difference dP1 across the remainder of the nozzle device 100 (cf. pressure difference dP1 and pressure difference dP3 in region 28). Thus, it is air rather than fuel which now flows through the deactivated pilot arrangement 23.

Under the high load conditions C, the pilot arrangement 23 is deactivated, i.e. it is air flowing in via the air opening 18 which flows through it. This state is qualitatively equivalent to the state under low load conditions B after fuel shut-off, with air throughflow 28.

In summary, the proposed configuration with the air opening 18 contributes to the at least occasional purging of the pilot arrangement 23 with air, and to reliable operation of the pilot arrangement 23, wherein it is possible, by means of the purging of fuel-carrying parts within the pilot arrangement 23, to effectively minimize or prevent coking of said parts.

LIST OF REFERENCE SIGNS

100 nozzle device
1 fuel feed
2 annular fuel reservoir
3 annular fuel line
4 fuel injector
5 outer and central air channel
6 swirling element
7 inner air channel
70 wall
71 outlet
8 central body
9 swirling arrangement
90 swirling element
10 air chamber
11 pilot fuel supply line
12 cavity
13 pilot fuel nozzle
130 pilot line
131 pilot fuel outlet
14 hollow chamber
15 weld
16 lance
17 throttle element
18 air opening
180 orifice opening
19 space with a widened cross section
20 porous structure
22 environment
23 pilot arrangement
24 diagram
25 ordinate
26 abscissa
27 fuel throughflow
28 air throughflow
A ignition condition
B low load condition
C high load condition
D diameter
d thickness
dP1 pressure difference
dP2 pressure difference
dP3 pressure difference
H height
L longitudinal axis
M central longitudinal axis
P0 air pressure

The invention claimed is:

1. A method for operating a gas turbine arrangement, comprising:

providing a gas turbine arrangement comprising a combustion chamber arrangement comprising at least one nozzle device and a turbine arrangement;

the at least one nozzle device comprising a pilot arrangement and an inner air channel, the inner air channel being arranged on a central longitudinal axis of the at least one nozzle device, the pilot arrangement being arranged within the inner air channel coaxially with the inner air channel;

the pilot arrangement comprising:

a pilot fuel nozzle;

a cavity extending along a longitudinal axis for conducting fuel, a narrowest flow cross section of the cavity being configured to be larger than a flow cross section of the pilot fuel nozzle, the pilot fuel nozzle, adjoining the cavity in a downstream direction and having a pilot line and a pilot fuel outlet arranged at a downstream end of the pilot line, the pilot line having a narrowest flow cross section which is configured to be smaller than the narrowest flow cross section of the cavity;

an air opening arranged on the pilot arrangement in flow connection with the cavity such that there is an at least occasional flow of air through at least the cavity and the pilot fuel nozzle during operation of the gas turbine arrangement;

wherein the cavity is arranged in a central body arranged on the longitudinal axis, and at least one swirling element is arranged circumferentially around the central body, wherein the central body and the at least one swirling element form a swirling arrangement;

at least one pilot fuel supply line for supplying fuel into the cavity, wherein the at least one pilot fuel supply line is guided through the at least one swirling element to conduct pilot fuel from a circumferential wall of the inner air channel radially inwards into the cavity;

providing an at least occasional flow of air through at least the cavity and the pilot fuel nozzle, flowing fuel through the pilot arrangement, while not flowing air and/or fuel through the air opening in flow contact with the cavity and the pilot fuel nozzle, and, providing that, when the pilot arrangement is deactivated, there is the at least occasional throughflow of air in a direction of the pilot fuel nozzle.

2. A pilot arrangement for use in a nozzle device of a gas turbine arrangement, comprising:

a pilot fuel nozzle;

a cavity extending along a longitudinal axis for conducting fuel, a narrowest flow cross section of the cavity being configured to be larger than a flow cross section of the pilot fuel nozzle, the pilot fuel nozzle, adjoining the cavity in a downstream direction and having a pilot line and a pilot fuel outlet arranged at a downstream end of the pilot line, the pilot line having a narrowest flow cross section which is configured to be smaller than the narrowest flow cross section of the cavity;

an air opening arranged on the pilot arrangement in flow connection with the cavity such that, when installed in the nozzle device of the gas turbine arrangement, there is an at least occasional flow of air through at least the cavity and the pilot fuel nozzle during operation of the gas turbine arrangement;

wherein the cavity is arranged in a central body arranged on the longitudinal axis, and at least one swirling element is arranged circumferentially around the central body, wherein the central body and the at least one swirling element form a swirling arrangement;

at least one pilot fuel supply line for supplying fuel into the cavity, wherein the at least one pilot fuel supply line is guided through the at least one swirling element to conduct pilot fuel from a circumferential wall of an inner air channel radially inwards into the cavity.

3. The pilot arrangement according to claim 2, wherein the at least one swirling element, the central body and the pilot fuel nozzle are configured as a continuous, integral component.

4. The pilot arrangement according to claim 2, wherein the air opening is arranged on a side of the pilot arrangement which faces upstream in relation to an air inflow direction in direct flow contact with the cavity or in direct flow contact with the at least one pilot fuel supply line on the at least one swirling element.

5. The pilot arrangement according to claim 2, wherein the air opening is configured to generate a pressure loss during operation such that, when there is a fuel flow through the pilot arrangement, there is no flow of air through the air opening and, after the fuel flow has been switched off, there is an at least occasional flow of air through the air opening.

6. The pilot arrangement according to claim 2, wherein the air opening includes at least one orifice opening and/or a porous structure.

7. The pilot arrangement according to claim 2, wherein the air opening is configured as a throttle element formed integrally with the pilot arrangement or as a separate throttle element attached to the pilot.

8. The pilot arrangement according to claim 2, and further comprising a hollow chamber arranged as a heat shield circumferentially around the pilot fuel nozzle and/or the cavity, wherein the hollow chamber is sealed in a flow-tight manner relative to an external environment.

9. The pilot arrangement according to claim 8, wherein the hollow chamber is arranged circumferentially around the pilot line.

10. The pilot arrangement according to claim 9, wherein the hollow chamber is filled with an inert gas or evacuated.

11. The pilot arrangement according to claim 2, wherein at the downstream end of the central body, a lance is provided which extends on the longitudinal axis and in which the pilot line extends, wherein the lance comprising the pilot line has an axial length such that the pilot fuel outlet is positioned at least in a downstream third or quarter of an inner air channel of the nozzle device when the pilot arrangement is installed in the nozzle device.

12. The pilot arrangement according to claim 11, wherein the pilot fuel outlet is positioned at least substantially at an outlet of the inner air channel of the at least one nozzle device.

13. A nozzle device comprising the pilot arrangement according to claim 2 and comprising an inner air channel, the inner air channel arranged on a central longitudinal axis of the nozzle device and within which the pilot arrangement is arranged coaxially with the inner air channel.

14. A gas turbine arrangement comprising a combustion chamber arrangement comprising at least one of the nozzle device according to claim 13 and a turbine arrangement.

* * * * *